US008056278B2

(12) United States Patent
Bentley

(10) Patent No.: US 8,056,278 B2
(45) Date of Patent: Nov. 15, 2011

(54) BARREL INSERT

(75) Inventor: James K. Bentley, Meridian, ID (US)

(73) Assignee: Krow Innovation, LLC, Paso Robles, CA (US)

( * ) Notice: Subject to any disclaimer, the term of this patent is extended or adjusted under 35 U.S.C. 154(b) by 0 days.

(21) Appl. No.: 12/612,932

(22) Filed: Nov. 5, 2009

(65) Prior Publication Data

US 2011/0099875 A1 May 5, 2011

(51) Int. Cl.
*F41A 21/10* (2006.01)

(52) U.S. Cl. ..... 42/75.02; 42/75.1

(58) Field of Classification Search ..... 42/75.02, 42/75.04, 75.1
See application file for complete search history.

(56) References Cited

U.S. PATENT DOCUMENTS

| | | | | | |
|---|---|---|---|---|---|
| 2,372,568 | A * | 3/1945 | Grigg | 42/75.01 |
| 2,935,912 | A * | 5/1960 | Hartley | 89/14.1 |
| 3,027,672 | A * | 4/1962 | Sullivan | 42/16 |
| 3,204,400 | A * | 9/1965 | Kvavle | 60/638 |
| 3,611,611 | A * | 10/1971 | Quinney | 42/75.02 |
| 3,842,527 | A * | 10/1974 | Low | 42/75.02 |
| 4,120,276 | A * | 10/1978 | Curran | 124/85 |
| 4,220,071 | A * | 9/1980 | Seiderman | 89/128 |
| 5,228,887 | A * | 7/1993 | Mayer | 42/75.02 |
| 6,301,817 | B1 * | 10/2001 | Hogue et al. | 42/71.01 |

* cited by examiner

*Primary Examiner* — Stephen M Johnson
(74) *Attorney, Agent, or Firm* — Zarian Midgley & Johnson PLLC

(57) ABSTRACT

A barrel insert is disclosed. A firearm may use a target barrel or another barrel, such as a standard barrel. The stock of a firearm may have a barrel receptacle that is shaped to hold a larger barrel. The larger barrel may be untapered. The barrel insert may be used to adapt a barrel receptacle to fit a smaller barrel. The smaller barrel may be tapered. The barrel insert may have a texture that substantially matches a texture of the firearm.

18 Claims, 3 Drawing Sheets

BARREL INSERT

BACKGROUND

1. Field of the Invention

The present application relates generally to firearms and more specifically to a barrel insert that may be used with a firearm.

2. Description of the Related Art

Generally, a firearm such as a long gun is an assembly of various components. The central component of the long gun is the receiver to which the barrel, ammunition feeding devices, trigger group, and various stocks may be attached. The barrel is a tube connected to the receiver, which is aligned with the chamber so that a fired round leaves the chamber and travels down the barrel. An end stock may be attached to the receiver so that it is positioned between the receiver and an operator's shoulder. Another type of stock that may be attached to the receiver is a forend stock. A forend stock is generally a longitudinal body connected to the front of the receiver. The bottom surface of the forend stock often may be grasped by the non-trigger hand of the operator when firing the firearm. The upper surface of the forend stock has a complementary shape that is specific to the barrel attached to the receiver. This complementary shape is herein referred to as a barrel receptacle. In some models, the barrel receptacle cradles the barrel for the length of the forend stock.

The particular shape of the barrel receptacle may limit the shape and/or type of barrel that may be used. Multiple sizes and/or types of barrels may be compatible with a particular receiver, but the barrel receptacle of the particular forend stock may prevent and/or make it undesirable for the use of more than one type of barrel with a specific forend stock. For example, a forend stock may be adapted for the use of a "bull" or "target" barrel. A target barrel is typically a barrel that does not have a taper and may also have a larger outer diameter than a standard barrel of the same caliber. The barrel receptacle of a "target barrel" forend stock does not taper so that the upper edges of the forend stock substantially abut against the target barrel along the length of the stock. A "target barrel" forend stock may not provide adequate support if used with a standard barrel, which is tapered. Specifically, there will be a gap between standard barrel and the "target barrel" forend stock because of the taper of the standard barrel. This gap between the standard barrel and the forend stock increases along the length of the stock due to the taper, which may be undesirable and/or may not provide adequate support while operating the firearm. This may require the purchase an additional forend stock for use with the standard barrel.

The present disclosure is directed toward overcoming, or at least reducing the effects of one or more of the issues set forth above.

SUMMARY

An embodiment of an insert for a stock of a long gun is disclosed. The insert may comprise a body having a first end, a second end, a first edge, a second end, and a longitudinal axis. The body may be curved about the longitudinal axis to create a barrel receptacle between the first edge and the second edge. The body may be adapted to mate with a barrel receptacle in the stock of the long gun. The barrel receptacle of the stock may be adapted to house a target barrel. The barrel receptacle of the body may be adapted to house a standard barrel. The insert of may further comprise a first flange and a second flange. The first flange and second flange may each have an opening for the insertion of a fastener, which may be used to secure the body to the stock of the long gun. The first edge and the second edge may each further comprise a texture that corresponds to a texture on the stock of the long gun. The body may further comprise a plurality of ribs between a portion of the first edge and the second edge. The barrel receptacle may further comprise a taper from the first end to the second end. The taper of the barrel receptacle may correspond to a taper of a standard barrel. The standard barrel may be adapted for use with .22 caliber ammunition.

A system to permit the use of at least two different barrels with a single gun stock is disclosed. The system may comprise a stock of a long gun having a barrel receptacle which may be adapted to house a target barrel. The stock may be connected to a receiver. The system may further comprise an insert which may have a barrel receptacle. The barrel receptacle may be adapted to house a standard barrel. The insert may be configured to be secured within the barrel receptacle of the stock. The insert may include a flange that may permit a fastener to secure the insert to the stock. The insert may have a first end, a second end. The barrel receptacle of the insert may be tapered from the first end to the second end. The taper may correspond to a taper of the standard barrel. The standard barrel may be adapted for use with .22 caliber ammunition.

A method of switching a barrel on a stock of a long gun is disclosed. The method may comprise placing an insert into a barrel receptacle of the stock of the long gun. The barrel receptacle of the stock may be adapted to house a target barrel such that an edge of the stock substantially abuts the target barrel for the length of the barrel receptacle of the stock. The method may further comprise securing the insert to the stock of the long gun and inserting a standard barrel into an opening in a receiver of the long gun. The standard barrel may be housed in a barrel receptacle of the insert. An edge of the insert may substantially abut the standard barrel for the length of the insert. The method may further comprise removing a target barrel from the barrel receptacle of the stock prior to placing the insert into the barrel receptacle. The standard barrel may be adapted for use with .22 caliber ammunition.

These and other embodiments of the present application will be discussed more fully in the description. The features, functions, and advantages can be achieved independently in various embodiments of the claimed invention, or may be combined in yet other embodiments.

BRIEF DESCRIPTION OF FIGURES

Like reference numbers and designations in the various drawings indicate like elements.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 1:
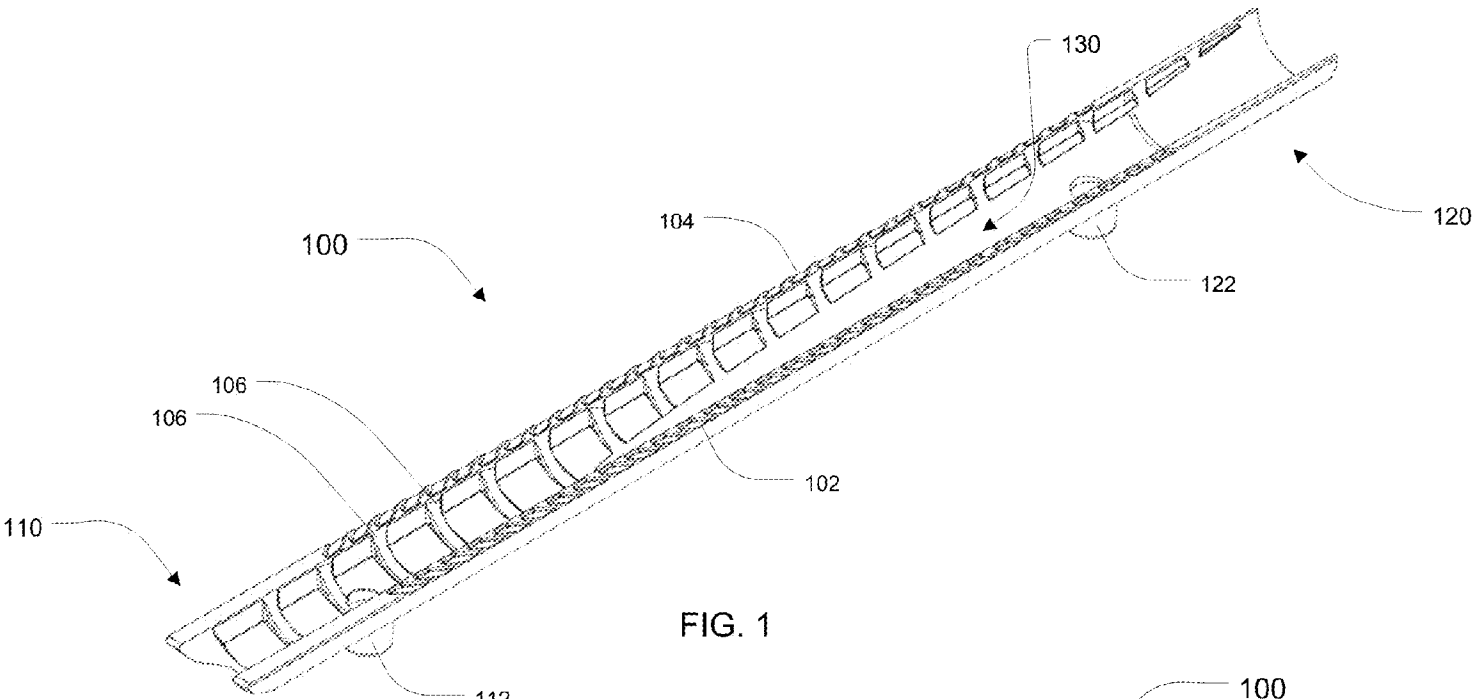
FIG. 1 is a perspective view of an embodiment of a barrel insert.
Figure 2:
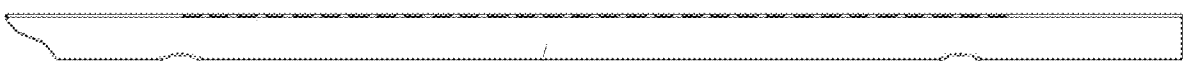
FIG. 2 is a side view of the embodiment of FIG. 1.
Figure 3:
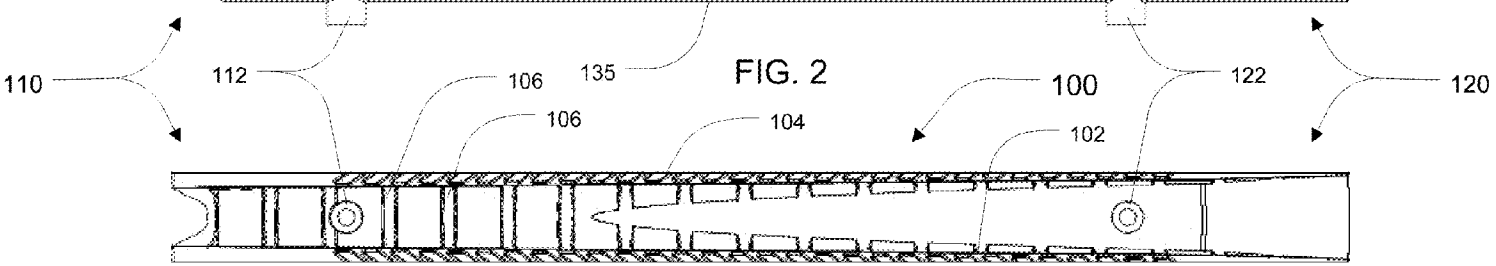
FIG. 3 is a top view of the embodiment of FIG. 1.
Figure 4:
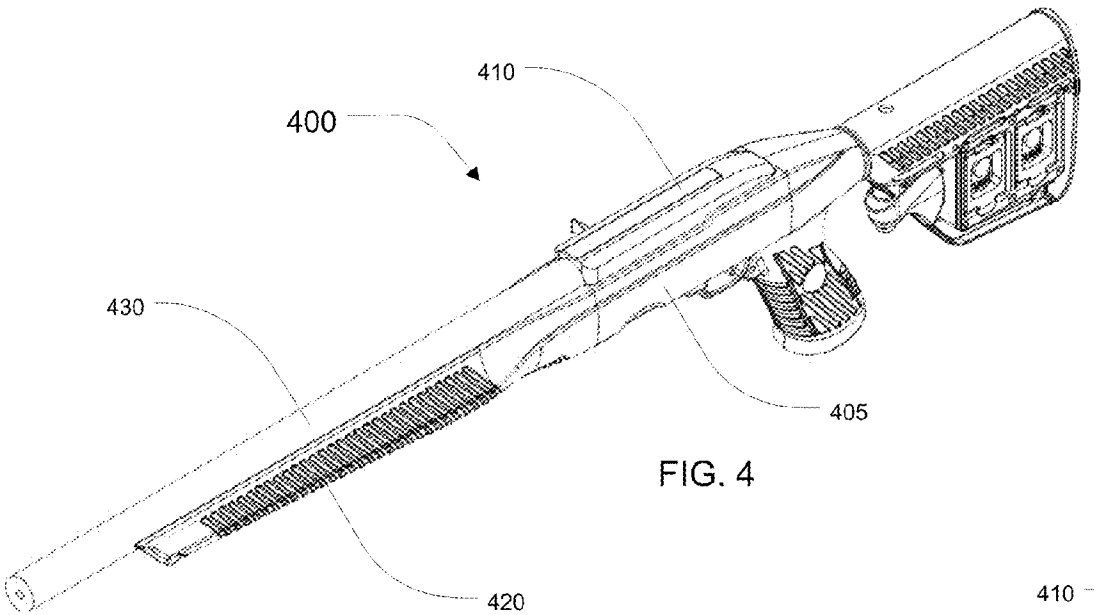
FIG. 4 is a perspective view of an embodiment of a firearm with a target barrel.
Figure 5:
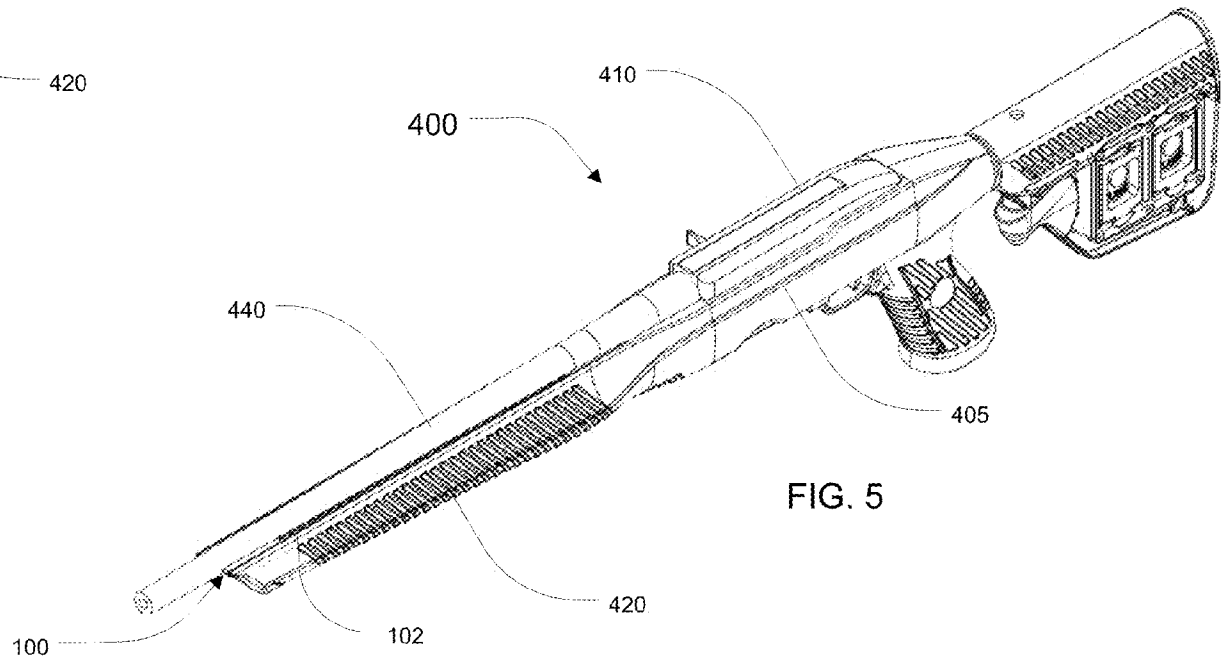
FIG. 5 is a perspective view of the embodiment of the firearm shown in FIG. 4 with a standard barrel and a barrel insert.

FIG. 1 is a perspective view of an embodiment of a barrel insert 100 that may be used with a firearm 400 (best shown in FIG. 5). FIGS. 2 and 3 are side and top views of the embodiment shown in FIG. 1. The top side of the barrel insert 100 is curved about a longitudinal axis, making a barrel receptacle 130. The barrel receptacle 130 is shaped to accept a standard barrel 440 (shown in FIG. 5). The bottom 135 of the barrel insert 100 is also curved about a longitudinal axis and is shaped substantially the same as a target barrel 430 (shown in FIG. 4).

A first edge 102 and a second edge 104 are shown at the extremities of the barrel receptacle 130. The first and second edges 102, 104 may include a texture that is substantially the same as the texture a textured portion 420 (shown in FIG. 5) of the firearm 400. In some alternative embodiments, the first and second edges 102, 104 may have a different texture than the texture of the firearm and/or may taper to a point.

A muzzle end 110 and receiver end 120 are also shown in FIG. 1. The barrel insert 100 and/or the barrel receptacle 130 may taper from the receiver end 120 to the muzzle end 110. The barrel insert 100 may be installed into the firearm 400 such that the receiver end 120 is closer to a receiver 410 (best shown in FIG. 5) than the muzzle end.

A plurality of ribs 106 are formed into the barrel receptacle 130. The ribs 106 may add strength to the barrel insert 100 and may support the barrel 440 if placed into the barrel receptacle 130.

A first flange 112, near the muzzle end 110, and a second flange 122, near the receiver end 120, extend down from the bottom of the barrel insert 100. The first and second flange 112, 122 each may comprise an opening extending from the bottom of each flange 112, 122 up through the barrel receptacle 130. The first and second flanges 112, 122 may complement a profile of a forend stock 405 (shown in FIG. 5). Additionally, the barrel insert 100 may be secured to a forend stock 405 with one or more fasteners installed through the first and/or second flanges 112, 122.

A barrel may be round or polygonal and may taper from the receiver toward the muzzle of the barrel. A target barrel is generally larger than a standard barrel, having a larger diameter, and thus, a greater mass than a standard barrel. Also, a target barrel generally does not taper from the receiver end to the muzzle end. Additional, a target barrel is generally thought to be more accurate and to have a more aggressive look that a standard barrel. By contrast, a standard barrel is any non-target barrel. For example, a standard barrel may be a barrel that has a smaller outer diameter that a target barrel, or may be a barrel that is longer or shorter that a target barrel, or may be a barrel with another suitable design. Generally, standard barrels are tapered from the receiver end to the muzzle end. A long gun, such as the firearm 400, may use the target barrel 430 interchangeably with an assembly including the standard barrel 440 in combination with a barrel insert 100.

FIG. 4 shows an embodiment of a firearm 400, such as a RUGER® 10/22® or another suitable long gun, comprising a forend stock 405 with a textured portion 420, and a receiver 410 installed in the forend stock 405. As illustrated in FIG. 4, the firearm 400 has a target barrel 430, also known as a bull barrel, installed in the forend stock 405 and in the receive 410.

FIG. 5 shows an embodiment of the firearm 400 comprising the same forend stock 405 with a standard barrel 440 connected to the receiver 410 and positioned in the forend stock 405. The firearm 400 also comprises a barrel insert 100 positioned between a forend stock 405 and the standard barrel 440. The addition of the barrel insert 100 permits the replacement of the target barrel 430 with the standard barrel 440 in the same stock 405. The first edge 102 of the barrel insert 100 is also shown and has a texture that substantially matches the textured portion 420 of the forend stock 405.

As can be seen by comparing FIGS. 4 and 5, the target barrel 430 is thicker and longer than the standard barrel 440. The target barrel 430 can be replaced with the standard barrel 440 with the addition of the barrel insert 100. Replacing the target barrel 430 with the standard barrel 440 reduces the weight of the firearm 400, thus making the firearm easier to carry.

Figure 7:
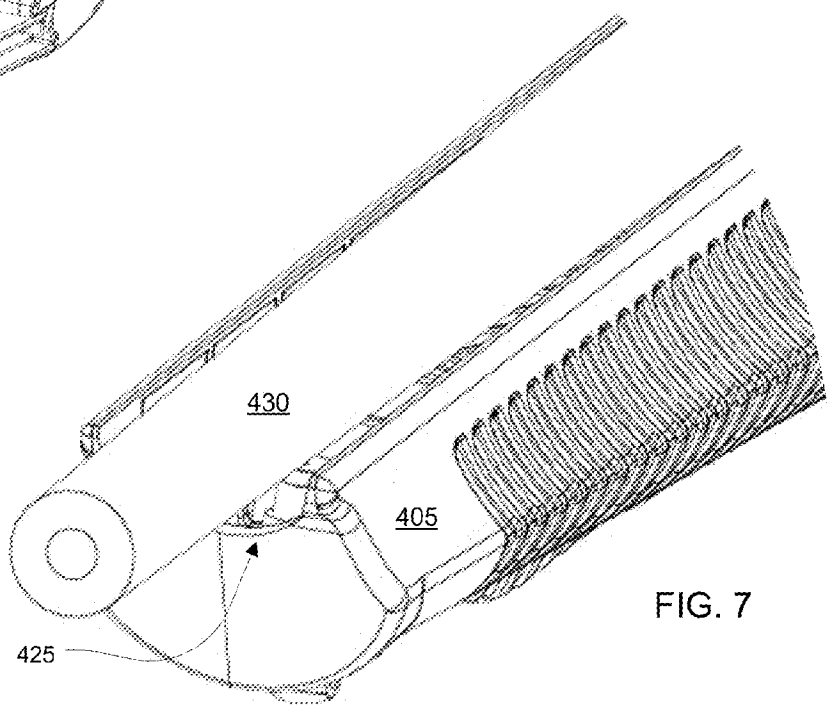
FIG. 7 is a partial close up view of FIG. 6, showing the front of the embodiment.
Figure 6:
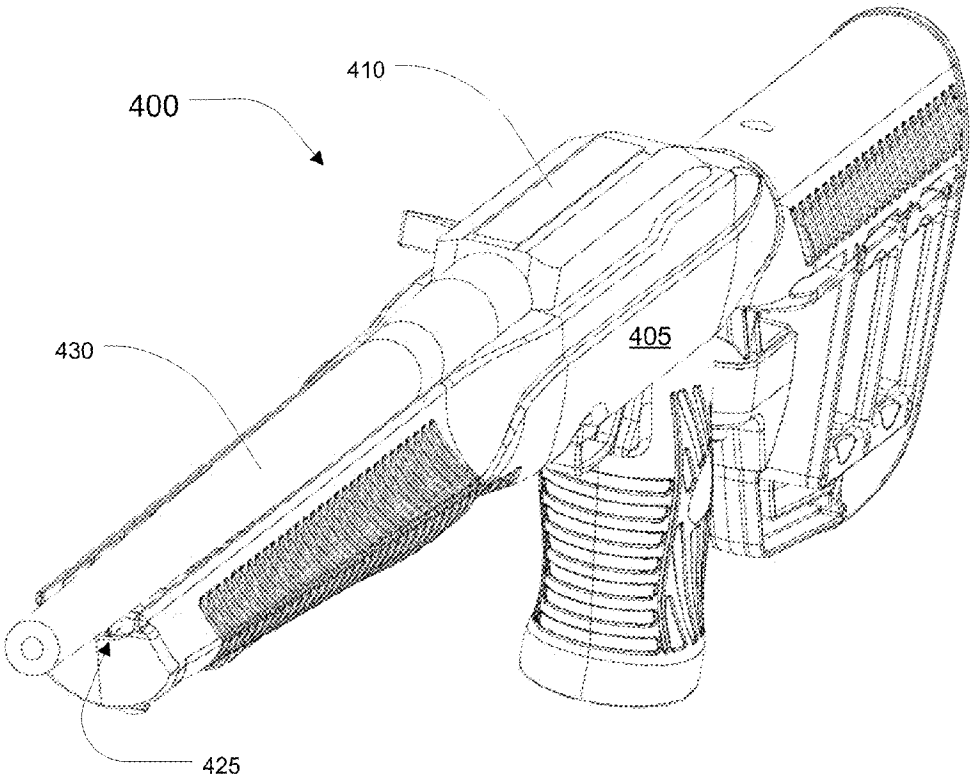
FIG. 6 is a perspective view of the embodiment of the firearm shown in FIG. 4 with a standard barrel and no barrel insert.

FIGS. 6 and 7 show a front perspective view and a close-up partial front perspective view of the firearm 400 in the configuration illustrated by FIG. 5, but without the barrel insert 100. As can be seen in FIGS. 6 and 7, a space or gap 425 is formed between the forend stock 405 and the standard barrel 440 when a standard barrel 440 is installed into the receiver 410 without the addition of a barrel insert 100. Operating the firearm 400 with the standard barrel 440 and without the barrel insert 100 installed into the forend stock 405 may be lead to unpredictable results and may be dangerous.

Although this invention has been described in terms of certain preferred embodiments, other embodiments that are apparent to those of ordinary skill in the art, including embodiments that do not provide all of the features and advantages set forth herein, are also within the scope of this invention. Therefore, the scope of the present invention is defined only by reference to the appended claims and equivalents thereof.

What is claimed is:

1. An insert for a stock of a firearm, the insert comprising:

a body having a first end, a second end, a first edge, a second edge, and a longitudinal axis, the body being curved about the longitudinal axis to create a first barrel receptacle between the first edge and the second edge;

wherein the first edge and the second edge each further comprise a texture that corresponds to a texture on the stock of the firearm;

the body being configured to be inserted into and to mate with a second barrel receptacle formed in the stock of the firearm, wherein, without the body, the second barrel receptacle is configured to house a target barrel; and wherein the first barrel receptacle is configured to house a standard barrel.

2. The insert of claim 1, wherein the body further comprises a plurality of ribs between a portion of the first edge and the second edge.

3. The insert of claim 1, wherein the first barrel receptacle further comprises a taper from the first end to the second end.

4. The insert of claim 3, wherein the taper of the first barrel receptacle corresponds to a taper of the standard barrel.

5. The insert of claim 1, wherein the standard barrel is configured for use with .22 caliber ammunition.

6. The insert of claim 1, wherein the body further comprises a top and a bottom, wherein the first barrel receptacle is formed into the top and wherein the bottom is shaped substantially the same as a target barrel.

7. The insert of claim 1, wherein the target barrel is configured for use with .22 caliber ammunition.

8. An insert for a firearm stock, the insert comprising:

a body having a receiver end, a muzzle end, a left edge, a right edge, a top side, a bottom side, and a longitudinal axis that is aligned with the body from the receiver end to the muzzle end;

wherein the left edge and the right edge each comprise a texture that corresponds to a texture on the firearm stock;

the top side being curved about the longitudinal axis, between the left edge and the right edge, to form a first barrel receptacle, the bottom side being curved about the longitudinal axis, between the left edge and the right edge, the curve of the bottom side being substantially the same as the curve of a target barrel; and the bottom side of the body being configured to mate with a second barrel receptacle that is formed into the firearm stock, the second barrel receptacle being shaped to conform to the target barrel.

9. The insert of claim 8, wherein the curve of the bottom side extends substantially from the receiver end to the muzzle end of the body.

10. The insert of claim 8, wherein the first barrel receptacle further comprises a taper about the longitudinal axis, at least partially from the receiver end to the muzzle end.

11. The insert of claim 10, wherein the taper of the first barrel receptacle corresponds to the shape of a standard barrel.

12. The insert of claim 11, wherein the standard barrel is configured for use with .22 caliber ammunition.

13. An insert for a firearm stock, the insert comprising:

a body having a receiver end, a muzzle end, a left edge, a right edge, a top side, a bottom side opposite the top side, and a longitudinal axis that is aligned with the body from the receiver end to the muzzle end;

wherein the left edge and the right edge each comprise a texture that corresponds to a texture on the firearm stock;

the top side being curved about the longitudinal axis, between the left edge and the right edge, to form a first barrel receptacle, the curve of the top side having a narrowing taper within the first barrel receptacle, the narrowing taper extending at least partially from the receiver end to the muzzle end; and the bottom side being curved about the longitudinal axis, between the left edge and the right edge, the curve of the bottom side being substantially untapered opposite the first barrel receptacle from the receiver end to the muzzle end.

14. The insert of claim 13, wherein the bottom side of the body is configured to complement a second barrel receptacle formed into the firearm stock, the second barrel receptacle being substantially untapered.

15. The insert of claim 13, wherein the taper of the first barrel receptacle corresponds to the shape of a standard barrel.

16. An insert for a stock of a firearm, the insert comprising:

a body having a first end, a second end, a first edge, a second edge, a longitudinal axis, the body being curved about the longitudinal axis to create a first barrel receptacle between the first edge and the second edge, a first flange, and a second flange, wherein the first flange and second flange each have an opening for the insertion of a fastener to secure the body to the stock of the firearm;

the body being configured to be inserted into and to mate with a second barrel receptacle formed in the stock of the firearm, wherein, without the body, the second barrel receptacle is configured to house a target barrel; and wherein the first barrel receptacle is configured to house a standard barrel.

17. An insert for a firearm stock, the insert comprising:

a body having a receiver end, a muzzle end, a left edge, a right edge, a top side, a bottom side, a longitudinal axis that is aligned with the body from the receiver end to the muzzle end, a first flange, and a second flange, wherein the first flange and the second flange each have an opening for the insertion of a fastener to secure the body to the firearm stock;

the top side being curved about the longitudinal axis, between the left edge and the right edge, to form a first barrel receptacle, the bottom side being curved about the longitudinal axis, between the left edge and the right edge, the curve of the bottom side being substantially the same as the curve of a target barrel; and the bottom side of the body being configured to mate with a second barrel receptacle that is formed into the firearm stock, the second barrel receptacle being shaped to conform to the target barrel.

18. An insert for a firearm stock, the insert comprising:

a body having a receiver end, a muzzle end, a left edge, a right edge, a top side, a bottom side, a longitudinal axis that is aligned with the body from the receiver end to the muzzle end, and a plurality of ribs between a portion of the left edge and the right edge;

the top side being curved about the longitudinal axis, between the left edge and the right edge, to form a first barrel receptacle, the bottom side being curved about the longitudinal axis, between the left edge and the right edge, the curve of the bottom side being substantially the same as the curve of a target barrel; and the bottom side of the body being configured to mate with a second barrel receptacle that is formed into the firearm stock, the second barrel receptacle being shaped to conform to the target barrel.

* * * * *